US009640925B2

(12) United States Patent
Tsai et al.

(10) Patent No.: US 9,640,925 B2
(45) Date of Patent: May 2, 2017

(54) STACKED RIGHT ANGLE CONNECTORS

(71) Applicant: ADVANCED-CONNECTEK INC., New Taipei (TW)

(72) Inventors: Yu-Lun Tsai, New Taipei (TW); Pin-Yuan Hou, New Taipei (TW); Chung-Fu Liao, New Taipei (TW); Ya-Fen Kao, New Taipei (TW); Rui Su, New Taipei (TW); Long-Fei Chen, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 14/992,406

(22) Filed: Jan. 11, 2016

(65) Prior Publication Data

US 2016/0211593 A1 Jul. 21, 2016

(30) Foreign Application Priority Data

Jan. 15, 2015 (CN) ..... 2015 1 0019599

(51) Int. Cl.

| | |
|---|---|
| ***H01R 13/648*** | (2006.01) |
| ***H01R 25/00*** | (2006.01) |
| ***H01R 13/66*** | (2006.01) |
| *H01R 24/60* | (2011.01) |
| *H01R 12/72* | (2011.01) |

(52) U.S. Cl.

CPC ..... *H01R 25/006* (2013.01); *H01R 13/6658* (2013.01); *H01R 12/724* (2013.01); *H01R 24/60* (2013.01)

(58) Field of Classification Search

CPC ... H01R 24/62; H01R 13/6586; H01R 13/659
USPC ..... 439/540.1, 541.5, 607.23
See application file for complete search history.

(56) References Cited

U.S. PATENT DOCUMENTS

| | | | | |
|---|---|---|---|---|
| 6,162,089 | A * | 12/2000 | Costello | H01R 23/6873 29/832 |
| 7,588,445 | B2 * | 9/2009 | He | H01R 23/6873 439/79 |
| 7,997,972 | B2 * | 8/2011 | Nguyen | G06Q 20/20 273/138.1 |
| 8,096,831 | B2 * | 1/2012 | Hsu | H01R 12/724 439/607.01 |

(Continued)

*Primary Examiner* — Vanessa Girardi
(74) *Attorney, Agent, or Firm* — Andrew M. Calderon; Roberts Mlotkowski Safran Cole & Calderon, P.C.

(57) ABSTRACT

An electrical receptacle connector includes a metallic shell, an insulated housing, first and second groups of terminals, an adapting circuit board, and extension terminals. The insulated housing is received in the metallic shell and includes a base portion, upper and lower tongue portions, and a partition plate. Upper and lower plug openings are respectively formed between the partition plate and the upper portion of the metallic shell and between the partition plate and the lower portion of the metallic shell. The terminals are held in the insulated housing. The adapting circuit board is disposed at the rear of the insulated housing and includes an upper-row contact set connected to the first group of terminals and a lower-row contact set. One ends of the extension terminals are connected to the lower-row contact set, and the other ends of the extension terminals are extended to the bottom of the insulated housing.

18 Claims, 10 Drawing Sheets

(56) References Cited

U.S. PATENT DOCUMENTS 8,113,882 B1 * 2/2012 Chen ..... H01R 13/6581
439/607.01

* cited by examiner

| | | | | | | | | | | | | |
|---|---|---|---|---|---|---|---|---|---|---|---|---|
| GND | TX1+ | TX1− | VBUS | CC1 | D+ | D− | RFU | VBUS | RX2− | RX2+ | GND | 21,31 |
| GND | RX1+ | RX1− | VBUS | RFU | D− | D+ | CC2 | VBUS | TX2− | TX2+ | GND | 22,32 |

Fig. 10

STACKED RIGHT ANGLE CONNECTORS

CROSS-REFERENCES TO RELATED APPLICATIONS

This non-provisional application claims priority under 35 U.S.C. §119(a) on Patent Application No. 201510019599.8 filed in China, P.R.C. on 2015 Jan. 15, the entire contents of which are hereby incorporated by reference.

FIELD OF THE INVENTION

The instant disclosure relates to an electrical connector, and more particular to an electrical receptacle connector.

BACKGROUND

Generally, Universal Serial Bus (USB) is a serial bus standard to the PC architecture with a focus on computer interface, consumer and productivity applications. The existing Universal Serial Bus (USB) interconnects have the attributes of plug-and-play and ease of use by end users. Now, as technology innovation marches forward, new kinds of devices, media formats and large inexpensive storage are converging. They require significantly more bus bandwidth to maintain the interactive experience that users have come to expect. In addition, the demand of a higher performance between the PC and the sophisticated peripheral is increasing.

Specifically, an existing USB type-C electrical receptacle connector includes an insulated housing, a plurality of first terminals, a plurality of second terminals, and a hollowed shell. The insulated housing includes a base portion and a tongue portion extended from one side of the base portion. The first terminals are held in the base portion and the tongue portion. The front of each of the first terminals is disposed at an upper surface of the tongue portion, and the rear of each of the first terminals is protruded from the base portion for connecting with a circuit board. The second terminals are held in the base portion and the tongue portion. The front of each of the second terminals is disposed at a lower surface of the tongue portion, and the rear of each of the second terminals is protruded from the base portion for connecting with the circuit board.

However, the existing USB type-C receptacle connector has a single plug opening and provides a USB 3.0 transmission interface therein. In other words, the existing USB type-C receptacle connector allows one plug connector to be mated therewith. Consequently, the existing USB type-C receptacle connector cannot allow the insertion of several plug connectors for signal transmission.

SUMMARY OF THE INVENTION

Consequently, how to improve the existing connector becomes an issue.

In view of this, an exemplary embodiment of the instant disclosure provides an electrical receptacle connector. The electrical receptacle connector comprises a metallic shell, an insulated housing, a first group of terminals, a second group of terminals, a circuit board, and a plurality of extension terminals. The metallic shell defines a receiving cavity. The insulated housing is received in the receiving cavity. The insulated housing comprises a base portion, an upper tongue portion, a lower tongue portion, and a partition plate. The upper tongue portion, the lower tongue portion, and the partition plate are extended from one side of the base portion and perpendicularly aligned to the base portion. The partition plate is between the upper tongue portion and the lower tongue portion. An upper insertion opening is formed between the partition plate and the upper portion of the metallic shell. A lower insertion opening is formed between the partition plate and the lower portion of the metallic shell. The first group of terminals is held in the insulated housing and comprises a plurality of upper-row receptacle terminals and a plurality of lower-row receptacle terminals. The upper-row receptacle terminals are held in the base portion and the upper tongue portion and disposed at the upper surface of the upper tongue portion. The upper-row receptacle terminals comprise a plurality of signal terminals, at least one power terminal, and at least one ground terminal. The lower-row receptacle terminals are held in the base portion and the upper tongue portion and disposed at the lower surface of the upper tongue portion. The lower-row receptacle terminals comprise a plurality of signal terminals, at least one power terminal, and at least one ground terminal. The second group of terminals is held in the insulated housing and comprises a plurality of upper-row receptacle terminals and a plurality of lower-row receptacle terminals. The upper-row receptacle terminals are held in the base portion and the lower tongue portion and disposed at the upper surface of the lower tongue portion. The upper-row receptacle terminals comprise a plurality of signal terminals, at least one power terminal, and at least one ground terminal. The lower-row receptacle terminals are held in the base portion and the lower tongue portion and disposed at the lower surface of the lower tongue portion. The lower-row receptacle terminals comprise a plurality of signal terminals, at least one power terminal, and at least one ground terminal. The circuit board is received in the receiving cavity and covers the rear of the base portion. The circuit board comprises an upper-row contact set and a lower-row contact set. The upper-row contact set is connected to the first group of terminals. Each of the extension terminals has two ends. One ends of the extension terminals are connected to the lower-row contact set, and the other ends of the extension terminals are extended to the bottom of the base portion.

Based on the above, the circuit board and the extension terminals allow the first group of terminals to be electrically connected to the circuit board. Therefore, the difficulties in manufacturing the electrical receptacle connector can be reduced, and the material for manufacturing the electrical receptacle connector can be reduced as well. In addition, the electrical receptacle connector with USB type-C connection interfaces can provide two insertion openings for mating with two electrical plug connectors.

Furthermore, the upper-row receptacle terminals and the lower-row receptacle terminals are arranged upside down, and the pin-assignment of the flat contact portions of the upper-row receptacle terminals is left-right reversal with respect to that of the flat contact portions of the lower-row receptacle terminals. Accordingly, the electrical receptacle connector can have a 180 degree symmetrical, dual or double orientation design and pin assignments which enables the upper insertion opening (or the lower insertion opening) of the electrical receptacle connector to be mated with a corresponding plug connector in either of two intuitive orientations, i.e. in either upside-up or upside-down directions. Therefore, when an electrical plug connector is inserted into the upper insertion opening (or the lower insertion opening) of the electrical receptacle connector with a first orientation, the flat contact portions of the upper-row receptacle terminals are in contact with upper-row plug terminals of the electrical plug connector. Conversely, when the electrical plug connector is inserted into the upper insertion opening (or the lower insertion opening) of the electrical receptacle connector with a second orientation, the flat contact portions of the lower-row receptacle terminals are in contact with the upper-row plug terminals of the electrical plug connector. Note that, the inserting orientation of the electrical plug connector is not limited by the electrical receptacle connector.

Detailed description of the characteristics and the advantages of the instant disclosure are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims and drawings in the instant disclosure.

BRIEF DESCRIPTION OF THE DRAWINGS

The instant disclosure will become more fully understood from the detailed description given herein below for illustration only, and thus not limitative of the instant disclosure, wherein:

FIG. 10 illustrates a schematic configuration diagram of the receptacle terminals of the electrical receptacle connector shown in FIG. 9.

DETAILED DESCRIPTION

Figure 1:
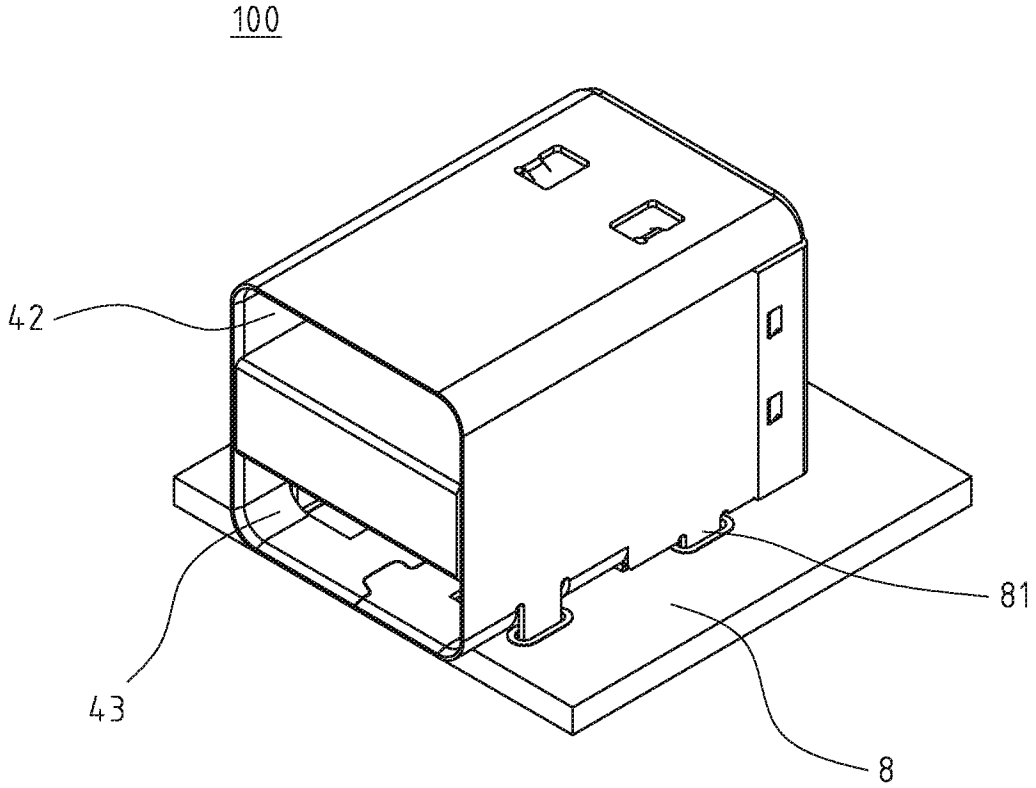
FIG. 1 illustrates a perspective view of an electrical receptacle connector according to an exemplary embodiment of the instant disclosure.
Figure 2:
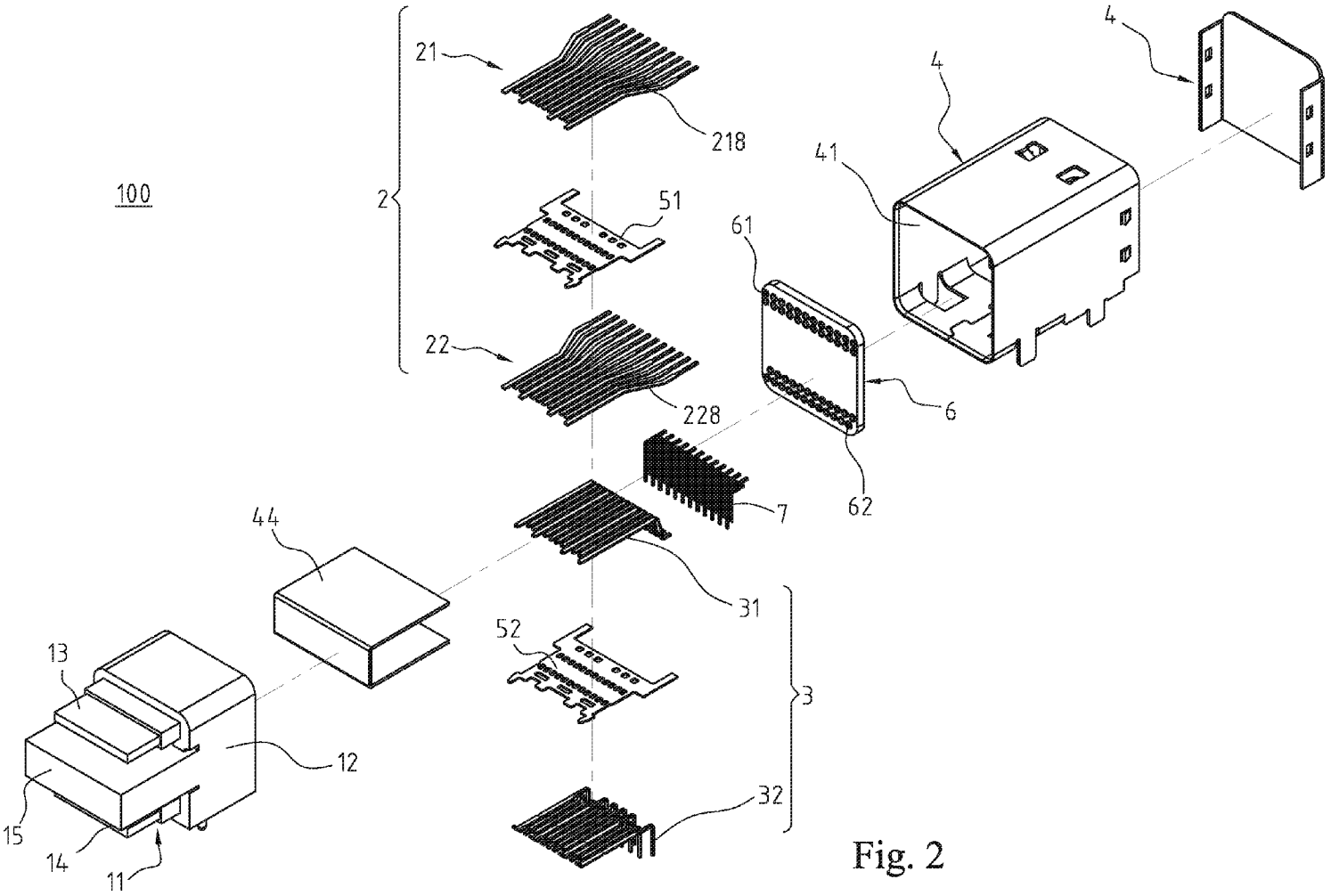
FIG. 2 illustrates an exploded view of the electrical receptacle connector.
Figure 3:
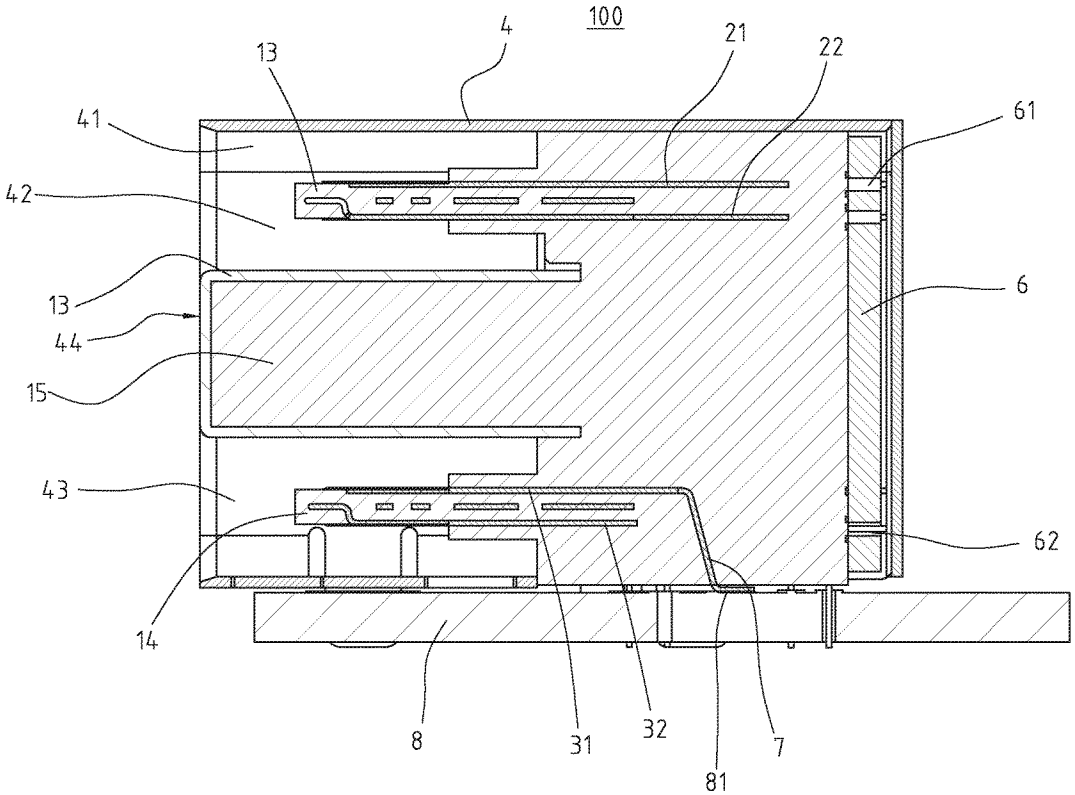
FIG. 3 illustrates a side sectional view of the electrical receptacle connector.

Please refer to FIGS. 1 to 3, which illustrate an electrical receptacle connector 100 of a first exemplary embodiment according to the instant disclosure. FIG. 1 illustrates a perspective view of the electrical receptacle connector 100. FIG. 2 illustrates an exploded view of the electrical receptacle connector 100. FIG. 3 illustrates a side sectional view of the electrical receptacle connector 100. In this embodiment, the electrical receptacle connector 100 can provide reversible or dual orientation USB Type-C connector interfaces and pin assignments, i.e., a USB Type-C receptacle connector. In this embodiment, the electrical receptacle connector 100 provides two insertion openings for inserting two plug connectors. In this embodiment, the electrical receptacle connector 100 may provide two USB 3.0 or two USB 3.1 connection interfaces, but embodiments are not limited thereto. In some embodiments, the electrical receptacle connector 100 may provide a USB 3.0 connection interface with a USB 2.0 connection interface, or may provide a USB 3.0 connection interface with a USB 2.0 connection interface. In another option, the electrical receptacle connector 100 may provide two USB 2.0 connection interfaces. In this embodiment, the electrical receptacle connector 100 comprises a metallic shell 4, an insulated housing 11, a first group of terminals 2, a second group of terminals 3, a circuit board 6, and a plurality of extension terminals 7. In addition, the metallic shell 4 is a hollowed shell. The metallic shell 4 defines a receiving cavity 41 therein. The insulated housing 11 is received in the receiving cavity 41 of the metallic shell 4, so that the metallic shell 4 encloses the insulated housing 11.

Figure 4:
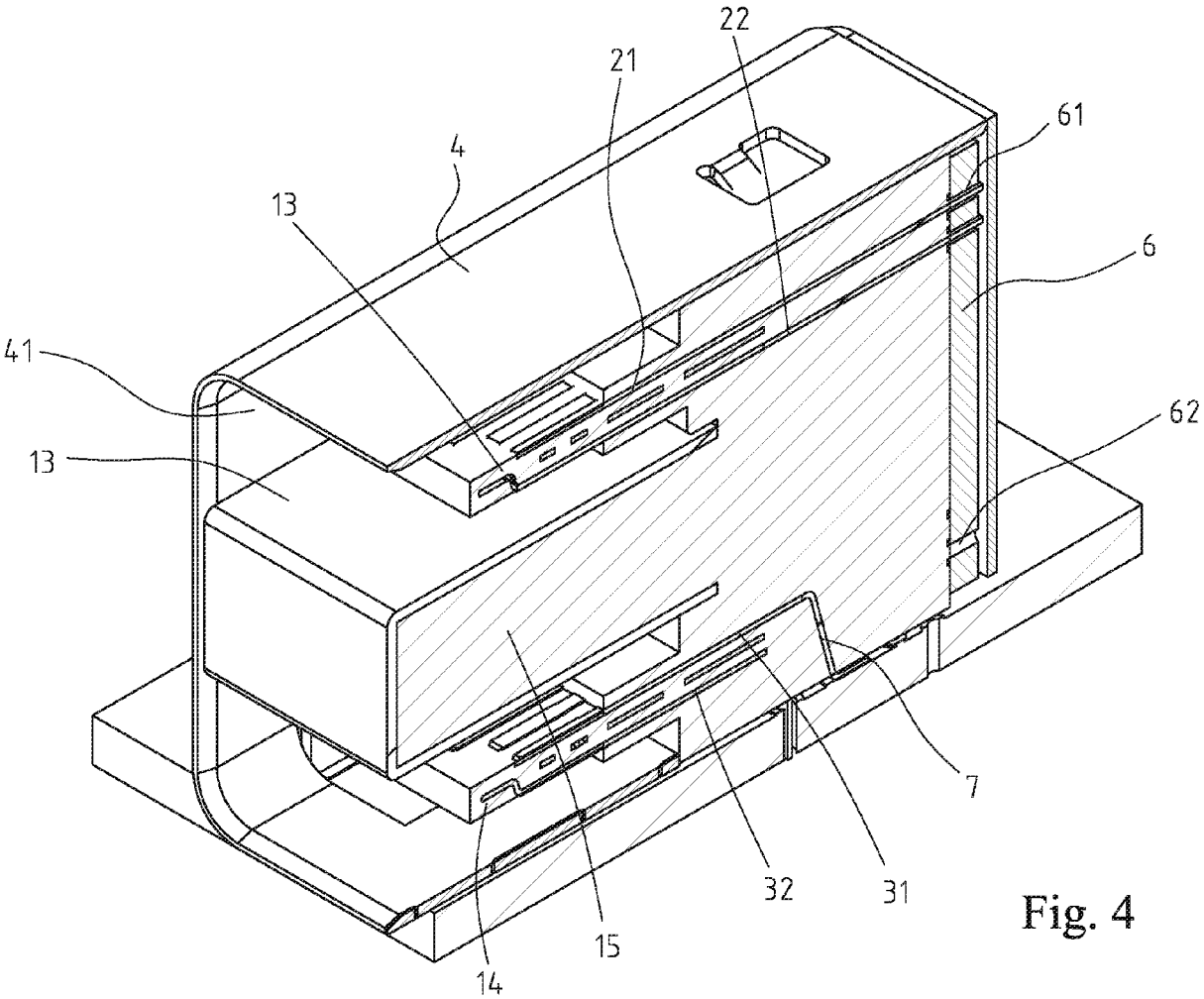
FIG. 4 illustrates a perspective sectional view of the electrical receptacle connector.
Figure 5:
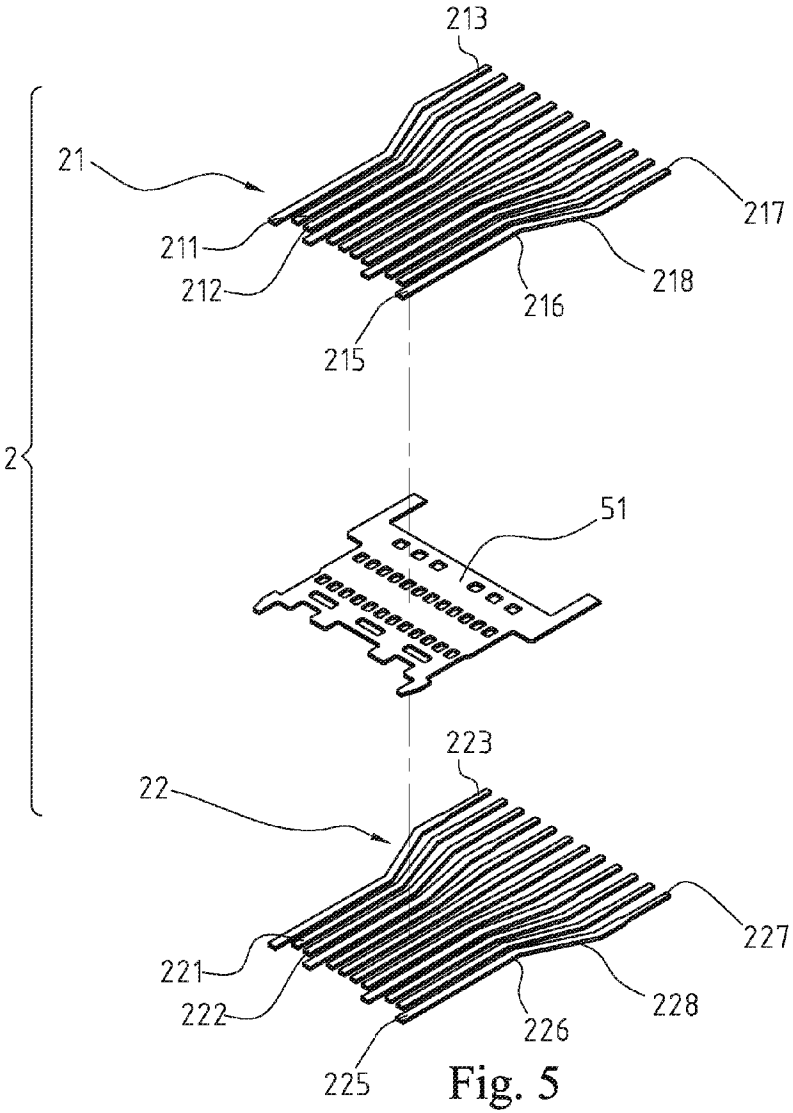
FIG. 5 illustrates an exploded view showing a first group of terminals and an upper-row grounding sheet of the electrical receptacle connector.

Please refer to FIGS. 2 to 4. The insulated housing 11 comprises a base portion 12, an upper tongue portion 13, a lower tongue portion 14, and a partition plate 15. The base portion 12, the upper tongue portion 13, the lower tongue portion 14, and the partition plate 15 may be formed by injection-molding techniques or the like. The upper tongue portion 13, the lower tongue portion 14, and the partition plate 15 are extended from one side of the base portion 12 to a front side of the base portion 12 which is the side mates with an electrical plug connector. The partition plate 15 is between the upper tongue portion 13 and the lower tongue portion 14. In addition, the upper tongue portion 13, the partition plate 15, and the lower tongue portion 14 are sequentially configured from top to bottom with the base portion 12. In addition, the upper tongue portion 13, the partition plate 15, and the lower tongue portion 14 are substantially perpendicularly to the connecting surface of the base portion 12. Moreover, an upper insertion opening 42 is formed between the partition plate 15 and the upper portion of the metallic shell 4; i.e., the upper insertion opening 42 is defined by the top of the partition plate 15, the top plate of the metallic shell 4, and the upper portions of the two side plates of the metallic shell 4. A lower insertion opening 43 is formed between the partition plate 15 and the lower portion of the metallic shell 4; i.e., the lower insertion opening 43 is defined by the bottom of the partition plate 15, the bottom plate of the metallic shell 4, and the lower portions of the two side plates of the metallic shell 4.

Please refer to FIGS. 2 to 5. The first group of terminals 2 is held in the insulated housing 11. The first group of terminals 2 comprises a plurality of upper-row receptacle terminals 21 and a plurality of lower-row receptacle terminals 22. The upper-row receptacle terminals 21 are held in the base portion 12 and the upper tongue portion 13 and are disposed at the upper surface of the upper tongue portion 13. The upper-row receptacle terminals 21 may be formed with the base portion 12 and the upper tongue portion 13 by inserting-molding techniques. Each of the upper-row receptacle terminals 21 comprises a flat contact portion 215, a body portion 216, and a tail portion 217. The body portions 216 are held in the base portion 12 and disposed at the upper tongue portion 13. Each of the flat contact portions 215 is extended from one of two ends of the corresponding body portion 216 and disposed at the upper surface of the upper tongue portion 13. Each of the tail portions 217 is extended from the other end of the corresponding body portion 216 and protruded from the rear of the base portion 12. The upper-row receptacle terminals 21 are disposed at the upper surface of the upper tongue portion 13 for transmitting first signals (i.e., USB 3.0 or USB 3.1 signals). The tail portions 217 of the upper-row receptacle terminals 21 are protruded from the base portion 12, and the tail portions 217 are formed as through-hole legs to be connected to the circuit board 6. In other words, the tail portions 217 are protruded from the rear of the base portion 12 and connected to an upper-row contact set 61 of the circuit board 6.

Please refer to FIGS. 2 to 5. The lower-row receptacle terminals 22 of the first group of terminals 2 are held in the base portion 12 and the upper tongue portion 13 and are disposed at the lower surface of the upper tongue portion 13. The lower-row receptacle terminals 22 may be formed with the base portion 12 and the upper tongue portion 13 by inserting-molding techniques. Each of the lower-row receptacle terminals 22 comprises a flat contact portion 225, a body portion 226, and a tail portion 227. The body portions 226 are held in the base portion 12 and disposed at the upper tongue portion 13. Each of the flat contact portions 225 is extended from one of two ends of the corresponding body portion 226 and disposed at the lower surface of the upper tongue portion 13. Each of the tail portions 227 is extended from the other end of the corresponding body portion 226 and protruded from the base portion 12. The lower-row receptacle terminals 22 are disposed at the lower surface of the upper tongue portion 13 for transmitting second signals (i.e., USB 3.0 or USB 3.1 signals). The tail portions 227 of the lower-row receptacle terminals 22 are protruded from the base portion 12, and the tail portions 227 are formed as through-hole legs to be connected to the circuit board 6. In other words, the tail portions 227 are protruded from the rear of the base portion 12 and connected to the upper-row contact set 61 of the circuit board 6.

Figure 7:
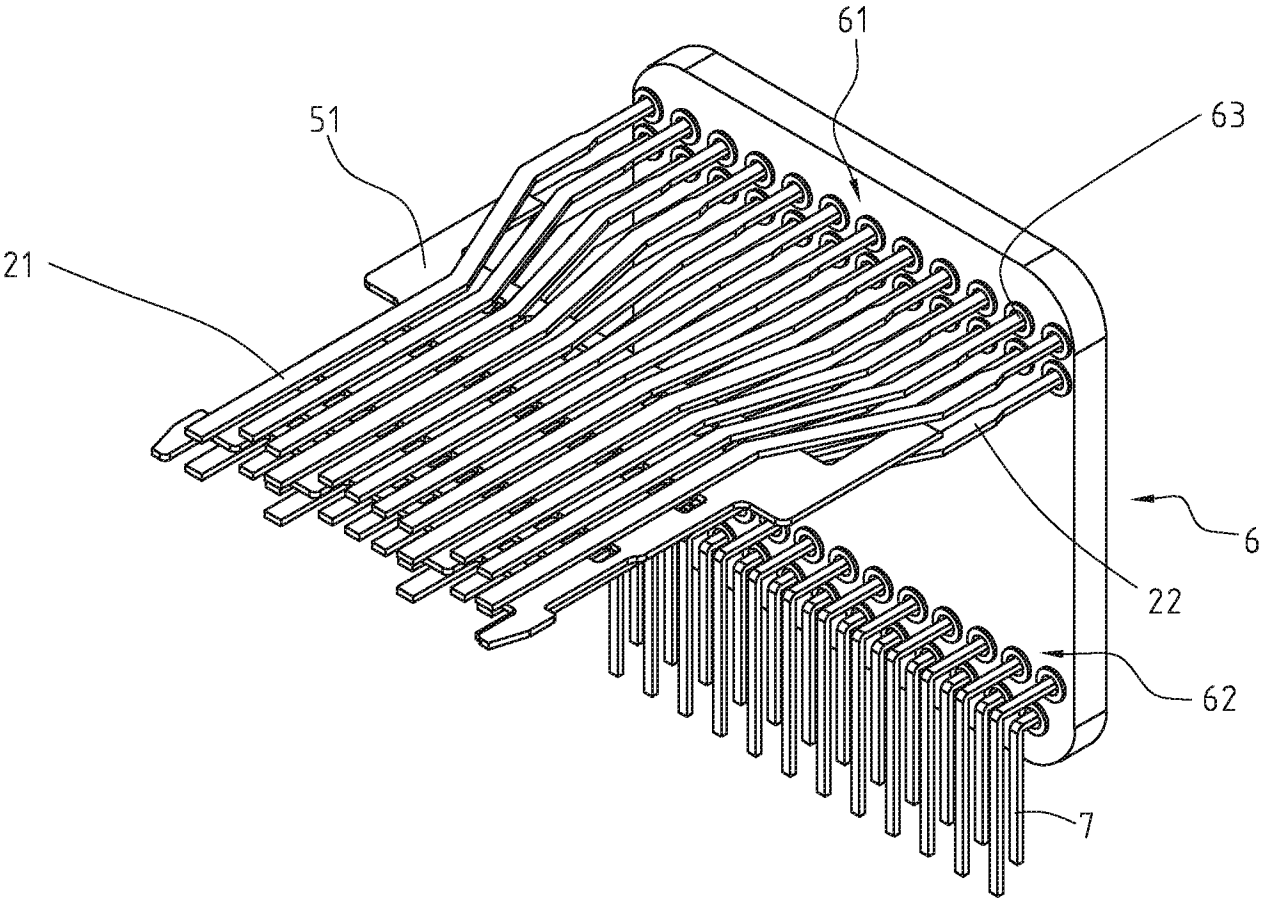
FIG. 7 illustrates a perspective view showing the first group of terminals, the upper-row grounding sheet, a circuit board, and extension terminals of the electrical receptacle connector.
Figure 8:
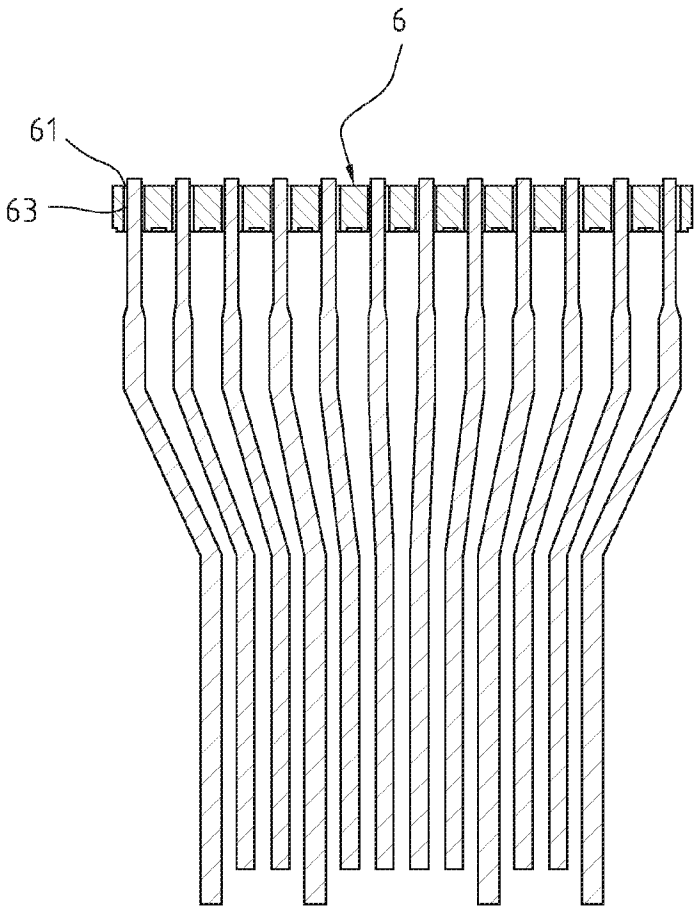
FIG. 8 illustrates a sectional view showing the first group of terminals and the circuit board of the electrical receptacle connector.

Please refer to FIG. 2, FIG. 7, and FIG. 8. The circuit board 6 is received in the receiving cavity 41 and covers the rear of the base portion 12. In this embodiment, the circuit board 6 is a standing type circuit board and the circuit board 6 is standingly attached on the rear of the base portion 12. In addition, the circuit board 6 comprises the upper-row contact set 61 connected to the first group of terminals 2, a lower-row contact set 62 connected to a plurality of extension terminals 7, and a plurality of layout wires. Two ends of each of the layout wires are respectively in contact with the upper-row contact set 61 and the lower-row contact set 62 to form independent circuits. In addition, the circuit board 6 further comprises a plurality of conductive holes 63. In this embodiment, the upper-row contact set 61 and the lower-row contact set 62 are formed as through holes; in other words, the upper-row contact set 61 and the lower-row contact set 62 are respectively formed as two rows of through holes. The through holes at the upper-row are provided for connecting with tail portions 217, 227 of the first group of terminals 2; particularly, the tail portions 217, 227 may be formed as through-hole legs. The through holes at the lower-row are provided for being inserted by one ends of the extension terminals 7; particularly, the extension terminals 7 may also be formed as through-hole legs. In some embodiments, the upper-row contact set 61 and the lower-row contact set 62 may be of surface soldering contacts, so that the tail portions 217, 227 of the first group of terminals 2 and the extension terminals 7 are connected to the upper-row contact set 61 and the lower-row contact set 62 by surface mounted technology (SMT). In this embodiment, after the upper-row contact set 61 and the lower-row contact set 62 are respectively formed as two rows of through holes, a conductive layer is coated on the inner wall of each of the through holes and electrically connected to the layout wires, so that the conductive holes 63 are formed. Moreover, in order to prevent the walls of the conductive holes 63 from being in contact with each other, distances are between each two adjacent conductive holes 63.

Please refer to FIG. 2, FIG. 7, and FIG. 8. In order to prevent the tail portions 217, 227 which are formed as through-hole legs from being in contact with each other when the tail portions 217, 227 are inserted into the conductive holes 63 of the upper-row contact set 61, distances between the tail portions 217 of two adjacent upper-row receptacle terminals 21 and distances between the tail portions 227 of two adjacent lower-row receptacle terminals 22 correspond to distances between two adjacent conductive holes 63. In other words, the distance between the tail portions 217 of each two adjacent upper-row receptacle terminals 21 equals to the interval between the corresponding two conductive holes 63, and the distance between the tail portions 227 of each two adjacent lower-row receptacle terminals 22 equals to the interval between the corresponding two conductive holes 63. In this embodiment, each of the upper-row receptacle terminals 21 further comprises an upper-row extension portion 218, and each of the lower-row receptacle terminals 22 further comprises a lower-row extension portion 228. The upper-row extension portion 218 is extended from the rear of the body portion 216 toward the tail portion 217, and the lower-row extension portion 228 is extended from the rear of the body portion 226 toward the tail portion 227. The upper-row extension portions 218 are provided to adjust the positions of the tail portions 217, so that each of the body portions 216 and the corresponding tail portion 217 are aligned at different horizontal lines. Accordingly, the positions of the tail portions 217 can be adjusted to correspond to the positions of the conductive holes 63, so that the tail portions 217 can be inserted into the conductive holes 63 and connected with the conductive holes 63. Similarly, the lower-tow extension portions 228 are provided to adjust the positions of the tail portions 227, so that each of the body portions 226 and the corresponding tail portion 227 are aligned at different horizontal lines. Accordingly, the positions of the tail portions 227 can be adjusted to correspond to the positions of the conductive holes 63, so that the tail portions 227 can be inserted into the conductive holes 63 and connected with the conductive holes 63. In other words, the upper-row extension portions 218 and the lower-row extension portions 228 are provided to widen the distance between two adjacent tail portions 217, 227, so that the distance between two adjacent tail portions 217, 227 meets the interval between the corresponding two adjacent conductive holes 63, hence, the tail portions 217, 227 can be inserted into the conductive holes 63.

In some embodiments, when the first group of terminals 2 are provided to transmit USB 2.0 signals, some of the first group of terminals 2 can be omitted (e.g., a first differential signal pair and a third differential signal pair). In other words, the first group of terminals 2 would thus comprise five upper-row receptacle terminals 21 and five lower-row receptacle terminals 22 for USB 2.0 signal transmission in this embodiment. Specifically, the upper-row receptacle terminals 21 comprise, from left to right in order, a detecting terminal (CC1), a signal pair 211 for transmitting USB 2.0 signals, i.e., a differential signal pair (D-+), a power terminal 212 (Power/VBUS), and a ground terminal (Gnd) at rightmost. Conversely, the lower-row receptacle terminals 22 comprise, from right to left in order, a detecting terminal (CC2), a signal pair 221 for transmitting USB 2.0 signals, i.e., a differential signal pair (D+–), a power terminal 222 (Power/VBUS), and a ground terminal 223 (Gnd) at leftmost. In this embodiment, neither the upper-row receptacle terminals 21 comprise the upper-row extension portions 218, nor do the lower-row receptacle terminals 22 comprise the lower-row extension portions 228. In addition, the number of the through holes of the upper-row contact set 61 can be reduced correspondingly. Accordingly, the distance between two adjacent tail portions 217 meets the interval between the corresponding two adjacent through holes at the upper row of the upper-row contact set 61, and the distance between two adjacent tail portions 227 meets the interval between the corresponding two adjacent through holes at the lower row of the upper-row contact set.

Please refer to FIG. 2 and FIG. 7. The extension terminals 7 are of L-shaped and each has two ends. One ends of the extension terminals 7 are connected to the lower-row contact set 62, i.e., one ends of the extension terminals 7 are inserted into the through holes of the lower-row contact set 62, and other ends of the extension terminals 7 are extended toward the bottom of the base portion 12. The extension terminals 7 may be formed with the base portion 12 by insert-molding techniques, and the two ends of each of the extension terminals 7 are protruded from the rear and the bottom of the base portion 12, respectively.

Figure 6:
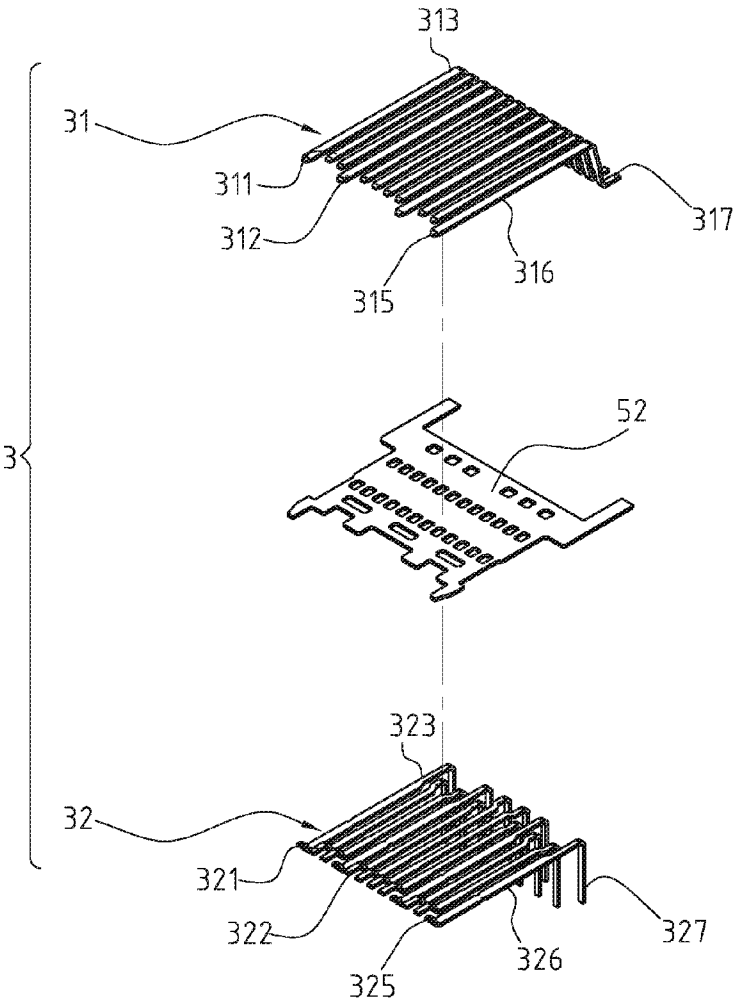
FIG. 6 illustrates an exploded view showing a second group of terminals and a lower-row grounding sheet of the electrical receptacle connector.

Please refer to FIG. 2, FIG. 3, and FIG. 6. The second group of terminals 3 is held in the insulated housing 11. The second group of terminals 3 comprises a plurality of upper-row receptacle terminals 31 and a plurality of lower-row receptacle terminals 32. The upper-row receptacle terminals 31 are held in the base portion 12 and the lower tongue portion 14 and are disposed at the upper surface of the lower tongue portion 14. The upper-row receptacle terminals 31 may be formed with the base portion 12 and the lower tongue portion 14 by insert-molding techniques. Each of the upper-row receptacle terminals 31 comprises a flat contact portion 315, a body portion 316, and a tail portion 317. The body portions 316 are held in the base portion 12 and disposed at the lower tongue portion 14. Each of the flat contact portions 315 is extended from one of two ends of the corresponding body portion 316 and disposed at the upper surface of the lower tongue portion 14. Each of the tail portions 317 is extended from the other end of the corresponding body portion 316 and protruded from the base portion 12. The upper-row receptacle terminals 31 are disposed at the upper surface of the lower tongue portion 14 for transmitting first signals (i.e., USB 3.0 or USB 3.1 signals). The tail portions 317 of the upper-row receptacle terminals 31 are protruded from the base portion 12, and the tail portions 317 are formed as SMT legs to be connected to the circuit board 6.

Please refer to FIGS. 2 to 4. The lower-row receptacle terminals 32 of the second group of terminals 3 are held in the base portion 12 and the lower tongue portion 14 and are disposed at the lower surface of the lower tongue portion 14. The lower-row receptacle terminals 32 may be formed with the base portion 12 and the lower tongue portion 14 by insert-molding techniques. Each of the lower-row receptacle terminals 32 comprises a flat contact portion 325, a body portion 326, and a tail portion 327. The body portions 326 are held in the base portion 12 and disposed at the lower tongue portion 14. Each of the flat contact portions 325 is extended from one of two ends of the corresponding body portion 326 and disposed at the lower surface of the lower tongue portion 14. Each of the tail portions 327 is extended from the other end of the corresponding body portion 326 and protruded from the base portion 12. The lower-row receptacle terminals 32 are disposed at the lower surface of the lower tongue portion 14 for transmitting second signals (i.e., USB 3.0 or USB 3.1 signals). The tail portions 327 of the lower-row receptacle terminals 32 are protruded from the base portion 12, and the tail portions 327 are formed as through-hole legs to be connected to the circuit board 6.

Please refer to FIG. 2, FIG. 3, FIG. 5, and FIG. 6. In one embodiment, when the first group of terminals 2 and the second group of terminals 3 of the electrical receptacle connector 100 are provided to transmit USB 3.0 or USB 3.1 signals, the electrical receptacle connector 100 may further comprise an upper-row grounding sheet 51 and a lower-row grounding sheet 52. The upper-row grounding sheet 51 and the lower-row grounding sheet 52 are both metallic sheets. The upper-row grounding sheet 51 is held in the insulated housing 11 and between the upper-row receptacle terminals 21 and the lower-row receptacle terminals 22 of the first group of terminals 2. The lower-row grounding sheet 52 is held in the insulated housing 11 and between the lower-row receptacle terminals 31 and the lower-row receptacle terminals 32 of the second group of terminals 3. Each of the grounding sheets 51, 52 comprises a body, buckles protruded from two sides of the body, and legs extended from the rear of the body. The bodies are of sheet shape. The body of the upper-row grounding sheet 51 is in the upper tongue portion 13, and the body of the lower-row grounding sheet 52 is in the lower tongue portion 14. The legs are extended from the rear of the body and protruded from the rear of the base portion 12 so as to be soldered with the circuit board 6 and a circuit board 8. The buckles of the upper-row grounding sheet 51 are protruded from two sides of the upper tongue portion 13, and the buckles of the lower-row grounding sheet 52 are protruded from two sides of the lower tongue portion 14. Because the grounding sheets 51, 52 are provided to separate the upper-row receptacle terminal 21/31 from the lower-row receptacle terminals 22/32, the crosstalk between the receptacle terminals 21, 22 of the first group of terminals 2 and the crosstalk between the receptacle terminals 31, 32 of the second group of terminals 3 can be improved respectively by the upper-row grounding sheet 51 and the lower-row grounding sheet 52 when the receptacle terminals 21, 22 of the first group of terminals 2 and the receptacle terminals 31, 32 of the second group of terminals 3 transmit signals. In addition, the structural strength of the upper tongue portion 13 can be improved by the assembly of the upper-row grounding sheet 51 and the upper tongue portion 13; similarly, the structural strength of the lower tongue portion 14 can be improved by the assembly of the lower-row grounding sheet 52 and the lower tongue portion 14. Moreover, when the first group of terminals 2 or the second group of terminals 3 of the electrical receptacle connector 100 is designated to transmit USB 2.0 signals, the upper-row grounding sheet 51 or the lower-row grounding sheet 52 may be omitted accordingly since the terminals for high speed signal transmission are omitted, too.

Please refer to FIGS. 2 to 4. The electrical receptacle connector 100 may further comprise a middle grounding sheet 44. The middle grounding sheet 44 is metal plate having U-shaped cross section. The middle grounding sheet 44 encloses the partition plate 15. The side portions of the middle grounding sheet 44 are electrically connected to the metallic shell 4. The middle grounding sheet 44 may be in contact with an electrical plug connector, and the plug terminals and the receptacle terminals 21/31, 22/32 can be conducted and grounded via the metallic shell 4. In addition, the middle grounding sheet 44 may be provided for improving the structural strength of the partition plate 15.

Please refer to FIG. 1, FIG. 3, and FIG. 4. The electrical receptacle connector 100 may further comprise a circuit board 8 disposed at the bottom of the insulated housing 8. The circuit board comprises a plurality of contacts 81 respectively connected to the second group of terminals 3 and the other ends of the extension terminals 7.

Please refer to FIG. 1, FIG. 2, FIG. 9, and FIG. 10. In this embodiment, the upper-row receptacle terminals 21 of the first group of terminals 2 comprise a plurality of signal terminals 211, at least one power terminal 212, and at least one ground terminal 213. The upper receptacle terminals 21 of the first group of terminals 2 are held in the base portion 12 and the upper tongue portion 13 and disposed at the upper surface of the upper tongue portion 13. Please refer to FIG. 9 and FIG. 10. The upper-row receptacle terminals 21 comprise, from left to right in order, a ground terminal 213 (Gnd), a first differential signal pair 211 (TX1+−), a second differential signal pair 211 (D+−), a third differential signal pair 211 (RX2+−), power terminals 212 (Power/VBUS) between the three differential signal pairs 211, a retain terminal (RFU), (the retain terminal and a configuration channel 1 (CC1), are respectively arranged between the power terminals 212 and the second differential signal pair 211), and a ground terminal 213 (Gnd) at rightmost. However, the pin assignment is not thus limited, and the example described above is only for illustrative purposes. That is, in practice, ground terminals 213 may be respectively arranged between the three differential signal pairs 211. In this embodiment, the upper-row receptacle terminals 21 have twelve terminals for transmitting USB 3.0 or USB 3.1 signals, but embodiments are not limited thereto. In some embodiments, the leftmost ground terminal 213 (or the rightmost ground terminal 213) and the retain terminal may be omitted. Additionally, the rightmost ground terminal 213 can be replaced by a power terminal 212 and provided for power transmission.

Similarly, in this embodiment, the upper-row receptacle terminals 31 of the second group of terminals 3 comprise a plurality of signal terminals 311, at least one power terminal 312, and at least one ground terminal 313. The pin assignments of the upper-row receptacle terminals 31 of the second group of terminals 3 are the same as that of the upper-row receptacle terminals 21 of the first group of terminals 2. Detail description of the upper-row receptacle terminals 31 of the second group of terminals 3 would not be further provided for the sake of convenience.

Please refer to FIG. 1, FIG. 2, FIG. 9, and FIG. 10. In this embodiment, the lower-row receptacle terminals 22 of the first group of terminals 2 comprise a plurality of signal terminals 221, at least one power terminal 222, and at least one ground terminal 223. The lower-row receptacle terminals 22 of the first group of terminals 2 are held in the base portion 12 and the upper tongue portion 13 and disposed at the lower surface of the upper tongue portion 13. Please refer to FIG. 9 and FIG. 10. The lower-row receptacle terminals 22 comprise, from right to left in order, a ground terminal 223 (Gnd), a first differential signal pair 221 (TX2+−), a second differential signal pair 221 (D+−), a third differential signal pair 221 (RX+−), power terminals 222 (Power/VBUS) between the three differential signal pairs 221, a retain terminal (RFU), (the retain terminal and a configuration channel 2 (CC2), are respectively arranged between the power terminals 222 and the second differential signal pair 221), and a ground terminal 223 (Gnd) at leftmost. However, the pin assignment is not thus limited, and the example described above is only for illustrative purposes. That is, in practice, ground terminals 223 may be respectively arranged between the three differential signal pairs 221. In this embodiment, the lower-row receptacle terminals 22 have twelve terminals for transmitting USB 3.0 or USB 3.1 signals, but embodiments are not limited thereto. In some embodiments, the leftmost ground terminal 223 (or the rightmost ground terminal 223) and the retain terminal may be omitted. Additionally, the leftmost ground terminal 223 can be replaced by a power terminal 222 and provided for power transmission.

Similarly, in this embodiment, the lower-row receptacle terminals 32 of the second group of terminals 3 comprise a plurality of signal terminals 321, at least one power terminal 322, and at least one ground terminal 323. The pin assignments of the lower-row receptacle terminals 32 of the second group of terminals 2 are the same as that of the lower-row receptacle terminals 22 of the first group of terminals 2. Detail description of the lower-row receptacle terminals 32 of the second group of terminals 3 would not be further provided for the sake of convenience.

In the previous embodiments, the upper-row receptacle terminals 21 or the lower-row receptacle terminals 22 of the first group of terminals 2 meet the transmission of USB 3.0 signals, but embodiments are not limited thereto. In some embodiments, the upper-row receptacle terminals 21 or the lower-row receptacle terminals 22 of the first group of terminals 2 may be provided for USB 2.0 signal transmission. Taking the upper-row receptacle terminals 21 in accordance with USB 2.0 signal transmission as an example, the first and third differential signal pairs 211 (TX1+− and RX2+−) are omitted, and at least the second differential signal pair 211 (D+−) and a power terminal (Power/VBUS) are retained for transmitting USB 2.0 signals. Conversely, in the previous embodiments, the upper-row receptacle terminals 31 or the lower-row receptacle terminals 32 of the second group of terminals 3 meet the transmission of USB 3.0 signals, but embodiments are not limited thereto. In some embodiments, the number of the upper-row receptacle terminals 31 or that of the lower-row receptacle terminals 32 of the second group of terminals 3 may be reduced, i.e., some of the terminals of the receptacle terminals 31, 32 are omitted, so that the upper-row receptacle terminals 31 or the lower-row receptacle terminals 32 of the second group of terminals 3 can be provided for USB 2.0 signal transmission.

Please refer to FIG. 1, FIG. 2, FIG. 9, and FIG. 10. In this embodiment, the upper-row receptacle terminals 21 and the lower-row receptacle terminals 22 of the first group of terminals 2 are respectively disposed at the upper surface and the lower surface of the upper tongue portion 13. Additionally, pin-assignments of the upper-row receptacle terminals 21 and the lower-row receptacle terminals 22 are point-symmetrical with a central point of the upper insertion opening 42 as the symmetrical center. In other words, pin-assignments of the upper-row receptacle terminals 21 and the lower-row receptacle terminals 22 have 180 degree symmetrical design with respect to the central point of the upper insertion opening 42 as the symmetrical center. The dual or double orientation design enables an electrical plug connector to be inserted into the upper insertion opening 42 of the electrical receptacle connector 100 in either of two intuitive orientations, i.e., in either upside-up or upside-down directions. Here, point-symmetry means that after the upper-row receptacle terminals 21 (or the lower-row receptacle terminals 22), are rotated by 180 degrees with the symmetrical center as the rotating center, the upper-row receptacle terminals 21 and the lower-row receptacle terminals 22 are overlapped. That is, the rotated upper-row receptacle terminals 21 are arranged at the position of the original lower-row receptacle terminals 22, and the rotated lower-row receptacle terminals 22 are arranged at the position of the original upper-row receptacle terminals 21. In other words, the upper-row receptacle terminals 21 and the lower-row receptacle terminals 22 are arranged upside down, and the pin assignments of the flat contact portions 215 are left-right reversal with respect to that of the flat contact portions 225. An electrical plug connector is inserted into the upper insertion opening 42 of the electrical receptacle connector 100 with a first orientation where the upper surface of the upper tongue portion 13 is facing up, for transmitting first signals. Conversely, the electrical plug connector is inserted into the upper insertion opening 42 of the electrical receptacle connector 100 with a second orientation where the upper surface of the upper tongue portion 13 is facing down, for transmitting second signals. Furthermore, the specification for transmitting the first signals is conformed to the specification for transmitting the second signals. In addition, in some embodiments, when an electrical plug connector comprises a plurality of upper-row plug terminals and a plurality of lower-row plug terminals, the upper-row receptacle terminals 21 or the lower-row receptacle terminals 22 may be omitted accordingly. When the upper-row receptacle terminals 21 are omitted, the electrical plug connector may be mated with the upper insertion opening 42 of the electrical receptacle connector 100 in either two of the intuitive orientations, so that the upper-row plug terminals or the lower-row plug terminals of the electrical plug connector are in contact with the lower-row receptacle terminals 22. Similarly, when the lower-row receptacle terminals 22 are omitted, the electrical plug connector may be mated with the upper insertion opening 42 of the electrical receptacle connector 100 in either two of the intuitive orientations, so that the upper-row plug terminals or the lower-row plug terminals of the electrical plug connector are in contact with the upper-row receptacle terminals 21. Note that, the inserting orientation of the electrical plug connector is not limited by the electrical receptacle connector 100 according embodiments of the instant disclosure.

Please refer to FIG. 1, FIG. 2, FIG. 9, and FIG. 10. In this embodiment, the upper-row receptacle terminals 31 and the lower-row receptacle terminals 32 of the second group of terminals 3 are respectively disposed at the upper surface and the lower surface of the lower tongue portion 14. Additionally, pin-assignments of the upper-row receptacle terminals 31 and the lower-row receptacle terminals 32 are point-symmetrical with a central point of the lower insertion opening 43 as the symmetrical center. Detail description of the second group of terminals would not be further provided for the sake of convenience.

Figure 9:
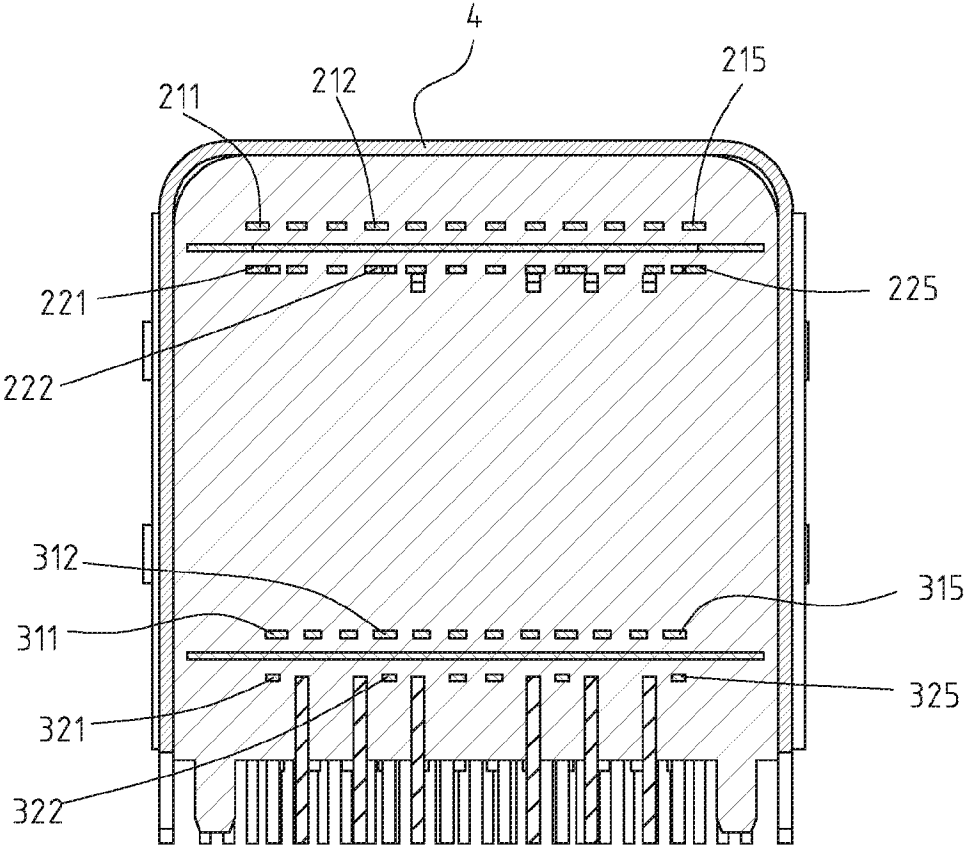
FIG. 9 illustrates a front sectional view of the electrical receptacle connector.

Please refer to FIG. 1, FIG. 2, FIG. 9, and FIG. 10. In this embodiment, as shown in FIG. 9 and FIG. 10, the position of the flat contact portions 215 corresponds to the position of the flat contact portions 225, but embodiments are not limited thereto. In some embodiments, the flat contact portions 215 are aligned by an offset with respect to the flat contact portions 225. Similarly, as shown in FIG. 9 and FIG. 10, the position of the flat contact portions 315 corresponds to the position of the flat contact portions 325. Accordingly, the inserting orientation of an electrical plug connector is not limited by the electrical receptacle connector 100 according embodiments of the instant disclosure.

Please refer to FIGS. 1 to 4. In this embodiment, the first group of terminals 2 and the second group of terminals 3 are assembled on the insulated housing 11, and the insulated housing 11 may comprise a plurality of terminal grooves allowing the insertion and the positioning of the first and second groups of terminals 2, 3. Alternatively, the first group of terminals 2 and the second group of terminals 3 may be assembled with the insulated housing 11 by insert-molding techniques. Similarly, the insulated housing 11 may comprise terminal grooved allowing the insertion and the positioning of the extension terminals 7; or, the extension terminals 7 may be assembled with the insulated housing 11 by insert-molding techniques. After the first group of terminals 2, the second group of terminals 3, and the extension terminals 7 are assembled with the insulated housing 11, the circuit board 6 is assembled with the first group of terminals 2 and the extension terminals 7. Next, the circuit board 8 is assembled at the bottom of the insulated housing 11.

Based on the above, the circuit board and the extension terminals allow the first group of terminals to be electrically connected to the circuit board. Therefore, the difficulties in manufacturing the electrical receptacle connector can be reduced, and the material for manufacturing the electrical receptacle connector can be reduced as well. In addition, the electrical receptacle connector with USB type-C connection interfaces can provide two insertion openings for mating with two electrical plug connectors.

Furthermore, the upper-row receptacle terminals and the lower-row receptacle terminals are arranged upside down, and the pin-assignment of the flat contact portions of the upper-row receptacle terminals is left-right reversal with respect to that of the flat contact portions of the lower-row receptacle terminals. Accordingly, the electrical receptacle connector can have a 180 degree symmetrical, dual or double orientation design and pin assignments which enables the upper insertion opening (or the lower insertion opening) of the electrical receptacle connector to be mated with a corresponding plug connector in either of two intuitive orientations, i.e. in either upside-up or upside-down directions. Therefore, when an electrical plug connector is inserted into the upper insertion opening (or the lower insertion opening) of the electrical receptacle connector with a first orientation, the flat contact portions of the upper-row receptacle terminals are in contact with upper-row plug terminals of the electrical plug connector. Conversely, when the electrical plug connector is inserted into the upper insertion opening (or the lower insertion opening) of the electrical receptacle connector with a second orientation, the flat contact portions of the lower-row receptacle terminals are in contact with the upper-row plug terminals of the electrical plug connector. Note that, the inserting orientation of the electrical plug connector is not limited by the electrical receptacle connector.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical receptacle connector, comprising:

a metallic shell defines a receiving cavity;

an insulated housing received in the receiving cavity, wherein the insulated housing comprises a base portion, an upper tongue portion having an upper surface and a lower surface, a lower tongue portion having an upper surface and a lower surface, and a partition plate, the upper tongue portion, the lower tongue portion, and the partition plate are extended from one side of the base portion, respectively, the upper tongue portion, the lower tongue portion, and the partition plate are perpendicularly aligned to the base portion, the partition plate is between the upper tongue portion and the lower tongue portion, an upper insertion opening is formed between the partition plate and the upper portion of the metallic shell, a lower insertion opening is formed between the partition plate and the lower portion of the metallic shell;

a first group of terminals held in the insulated housing, wherein the first group of terminals comprises:

a plurality of upper-row receptacle terminals held in the base portion and the upper tongue portion and disposed at the upper surface of the upper tongue portion, wherein the upper-row receptacle terminals comprise a plurality of signal terminals, at least one power terminal, and at least one ground terminal; and a plurality of lower-row receptacle terminals held in the base portion and the upper tongue portion and disposed at the lower surface of the upper tongue portion, wherein the lower-row receptacle terminals comprise a plurality of signal terminals, at least one power terminal, and at least one ground terminal, each of the lower-row receptacle terminals of the first group of terminals comprises a flat contact portion, a body portion, and a tail portion, the body portions are held in the base portion and disposed at the lower surface of the upper tongue portion, each of the flat contact portions is extended from one of two ends of the corresponding body portion and disposed at the lower surface of the upper tongue portion, and each of the tail portions is extended from the other end of the corresponding body portion, protruded from the rear of the base portion, and connected to the upper-row contact set;

a second group of terminals held in the insulated housing, wherein the second group of terminals comprises:

a plurality of upper-row receptacle terminals held in the base portion and the lower tongue portion and disposed at the upper surface of the lower tongue portion, wherein the upper-row receptacle terminals comprise a plurality of signal terminals, at least one power terminal, and at least one ground terminal; and a plurality of lower-row receptacle terminals held in the base portion and the lower tongue portion and disposed at the lower surface of the lower tongue portion, wherein the lower-row receptacle terminals comprise a plurality of signal terminals, at least one power terminal, and at least one ground terminal;

a circuit board received in the receiving cavity and covering the rear of the base portion, wherein the circuit board comprises an upper-row contact set and a lower-row contact set, the upper-row contact set is connected to the first group of terminals; and a plurality of extension terminals, each having two ends, wherein one ends of the extension terminals are connected to the lower-row contact set, and the other ends of the extension terminals are extended toward the bottom of the base portion.

2. An electrical receptacle connector, comprising:

a metallic shell defines a receiving cavity;

an insulated housing received in the receiving cavity, wherein the insulated housing comprises a base portion, an upper tongue portion having an upper surface and a lower surface, a lower tongue portion having an upper surface and a lower surface, and a partition plate, the upper tongue portion, the lower tongue portion, and the partition plate are extended from one side of the base portion, respectively, the upper tongue portion, the lower tongue portion, and the partition plate are perpendicularly aligned to the base portion, the partition plate is between the upper tongue portion and the lower tongue portion, an upper insertion opening is formed between the partition plate and the upper portion of the metallic shell, a lower insertion opening is formed between the partition plate and the lower portion of the metallic shell;

a first group of terminals held in the insulated housing, wherein the first group of terminals comprises:

a plurality of upper-row receptacle terminals held in the base portion and the upper tongue portion and disposed at the upper surface of the upper tongue portion, wherein; and a plurality of lower-row receptacle terminals held in the base portion and the upper tongue portion and disposed at the lower surface of the upper tongue portion, wherein each of the lower-row receptacle terminals of the first group of terminals comprises a flat contact portion, a body portion, and a tail portion, the body portions are held in the base portion and disposed at the lower surface of the upper tongue portion, each of the flat contact portions is extended from one of two ends of the corresponding body portion and disposed at the lower surface of the upper tongue portion, and each of the tail portions is extended from the other end of the corresponding body portion, protruded from the rear of the base portion, and connected to the upper-row contact set;

a second group of terminals held in the insulated housing, wherein the second group of terminals comprises:

a plurality of upper-row receptacle terminals held in the base portion and the lower tongue portion and disposed at the upper surface of the lower tongue portion; and a plurality of lower-row receptacle terminals held in the base portion and the lower tongue portion and disposed at the lower surface of the lower tongue portion;

circuit board received in the receiving cavity and covering the rear of the base portion, wherein the circuit board comprises an upper-row contact set and a lower-row contact set, the upper-row contact set is connected to the first group of terminals; and a plurality of extension terminals, each having two ends, wherein one ends of the extension terminals are connected to the lower-row contact set, and the other ends of the extension terminals are extended toward the bottom of the base portion.

3. The electrical receptacle connector according to claim 2, wherein each of the lower-row receptacle terminals of the first group of terminals comprises a lower-row extension portion extended from the rear of the body portion toward the tail portion.

4. The electrical receptacle connector according to claim 2, further comprising an upper-row grounding sheet held in the insulated housing and between the upper-row receptacle terminals and the lower-row receptacle terminals of the first group of terminals.

5. The electrical receptacle connector according to claim 2, wherein each of the upper-row receptacle terminals of the second group of terminals comprises a flat contact portion, a body portion, and a tail portion, wherein the body portions are held in the base portion and disposed at the upper surface of the lower tongue portion, each of the flat contact portions is extended from one of two ends of the corresponding body portion and disposed at the upper surface of the lower tongue portion, and each of the tail portions is extended from the other end of the corresponding body portion and protruded from the bottom of the base portion.

6. The electrical receptacle connector according to claim 2, wherein each of the lower-row receptacle terminals of the second group of terminals comprises a flat contact portion, a body portion, and a tail portion, wherein the body portions are held in the base portion and disposed at the lower surface of the lower tongue portion, each of the flat contact portions is extended from one of two ends of the corresponding body portion and disposed at the lower surface of the lower tongue portion, and each of the tail portions is extended from the other end of the corresponding body portion and protruded from the bottom of the base portion.

7. The electrical receptacle connector according to claim 2, further comprising a lower-row grounding sheet held in the insulated housing and between the upper-row receptacle terminals and the lower-row receptacle terminals of the second group of terminals.

8. The electrical receptacle connector according to claim 2, further comprising a circuit board disposed at the bottom of the insulated housing, wherein the circuit board comprises a plurality of contacts respectively connected to the second group of terminals and the other ends of the extension terminals.

9. The electrical receptacle connector according to claim 2, wherein the upper-row receptacle terminals of the first group of terminals comprise a plurality of signal terminals, at least one power terminal, and at least one ground terminal.

10. The electrical receptacle connector according to claim 2, wherein the lower-row receptacle terminals of the first group of terminals comprise a plurality of signal terminals, at least one power terminal, and at least one ground terminal.

11. The electrical receptacle connector according to claim 2, wherein the upper-row receptacle terminals of the second group of terminals comprise a plurality of signal terminals, at least one power terminal, and at least one ground terminal.

12. The electrical receptacle connector according to claim 2, wherein the lower-row receptacle terminals of the second group of terminals comprise a plurality of signal terminals, at least one power terminal, and at least one ground terminal.

13. The electrical receptacle connector according to claim 2, wherein each of the upper-row receptacle terminals of the first group of terminals comprises a flat contact portion, a body portion, and a tail portion, wherein the body portions are held in the base portion and disposed at the upper surface of the upper tongue portion, each of the flat contact portions is extended from one of two ends of the corresponding body portion and disposed at the upper surface of the upper tongue portion, and each of the tail portions is extended from the other end of the corresponding body portion, protruded from the rear of the base portion, and connected to the upper-row contact set.

14. The electrical receptacle connector according to claim 13, wherein each of the upper-row receptacle terminals of the first group of terminals comprises an upper-row extension portion extended from the rear of the body portion toward the tail portion.

15. The electrical receptacle connector according to claim 2, wherein the upper-row receptacle terminals and the lower-row receptacle terminals of the first group of terminals have 180 degree symmetrical design with respect to a central point of the upper insertion opening as the symmetrical center.

16. The electrical receptacle connector according to claim 15, wherein the position of the upper-row receptacle terminals of the first group of terminals corresponds to the position of the lower-row receptacle terminals of the first group of terminals.

17. The electrical receptacle connector according to claim 2, wherein the upper-row receptacle terminals and the lower-row receptacle terminals of the second group of terminals have 180 degree symmetrical design with respect to a central point of the lower insertion opening as the symmetrical center.

18. The electrical receptacle connector according to claim 17, wherein the position of the upper-row receptacle terminals of the second group of terminals corresponds to the position of the lower-row receptacle terminals of the second group of terminals.

* * * * *